US008311250B2

(12) United States Patent
Hamacher

(10) Patent No.: US 8,311,250 B2
(45) Date of Patent: Nov. 13, 2012

(54) METHOD FOR ADJUSTING A HEARING AID WITH HIGH-FREQUENCY AMPLIFICATION

(75) Inventor: Volkmar Hamacher, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1610 days.

(21) Appl. No.: 11/787,691

(22) Filed: Apr. 17, 2007

(65) Prior Publication Data

US 2007/0280494 A1 Dec. 6, 2007

(30) Foreign Application Priority Data

Apr. 27, 2006 (DE) ..... 10 2006 019 694

(51) Int. Cl.
*H04R 25/00* (2006.01)

(52) U.S. Cl. ..... 381/320; 381/60; 381/321

(58) Field of Classification Search ..... 381/60, 381/312–331

See application file for complete search history.

(56) References Cited

U.S. PATENT DOCUMENTS

| | | | | |
|---|---|---|---|---|
| 4,630,305 | A | 12/1986 | Borth et al. | |
| 5,276,739 | A | 1/1994 | Krokstad et al. | |
| 5,991,417 | A * | 11/1999 | Topholm | 381/60 |
| 6,134,329 | A * | 10/2000 | Gao et al. | 381/60 |
| 6,408,273 | B1 | 6/2002 | Quargliaro et al. | |
| 7,058,182 | B2 * | 6/2006 | Kates | 381/60 |
| 7,349,549 | B2 * | 3/2008 | Bachler et al. | 381/314 |
| 2003/0002699 | A1 * | 1/2003 | Schulz et al. | 381/316 |
| 2004/0151332 | A1 * | 8/2004 | Danielsen et al. | 381/318 |

FOREIGN PATENT DOCUMENTS

| | | | |
|---|---|---|---|
| CH | 678 692 | A5 | 10/1991 |
| DE | 35 42 566 | A1 | 7/1986 |
| DE | 690 12 582 | T2 | 9/1992 |
| DE | 41 25 378 | C1 | 10/1992 |
| DE | 44 41 755 | C1 | 1/1996 |
| DE | 699 16 756 | T2 | 6/2000 |
| DE | 10110258 | C1 | 8/2002 |
| DE | 10131964 | A1 | 1/2003 |

(Continued)

OTHER PUBLICATIONS

D14: Hörakustik Oct. 2004, pp. 104-105 D14a: Screenshot eines Windows-Explorers zeigend den Inhalt einer CD-ROM an HIMSA-Mitglieder enthaltend die Connexx 5.0/5.0a Software mit Erzeugungsdatum vom Dec. 15, 2004 D14b: Datenblatt SIE 00258 zu Siemens- Hörgerät "ACURIS P" mit Editionsvermerk "Sep. 2004"; Others; 2004; DE.

(Continued)

*Primary Examiner* — Curtis Kuntz
*Assistant Examiner* — Ryan Robinson

(57) ABSTRACT

It should be possible to quickly and effectively adjust a hearing aid even in the high-frequency range above 8 kHz. For this purpose it is provided that an open-loop gain measurement is carried out in the upper frequency range and a maximum amplification or a frequency-dependent maximum amplification curve is fixed. This maximum amplification in the high-frequency range should not be exceeded. The hearing aid wearer can then optionally select one of a plurality of amplification curves located there below. In the low-frequency range a conventional amplification adjustment is carried out for example by a prescriptive audiogram-based formula. A hybrid adjustment procedure that is easy to carry out is thereby provided for the entire frequency range.

18 Claims, 2 Drawing Sheets

FOREIGN PATENT DOCUMENTS

| | | | |
|---|---|---|---|
| DE | 10344032 | A1 | 6/2005 |
| DE | 122005020317 | A1 | 11/2006 |
| EP | 0845921 | A1 | 6/1998 |
| EP | 0 917 397 | A1 | 5/1999 |
| EP | 1 414 271 | A2 | 4/2004 |
| EP | 1448022 | A1 | 8/2004 |
| WO | 9409604 | A1 | 4/1994 |

OTHER PUBLICATIONS

D15: Screenshot der Benutzeroberfläche der Hörgeräteanpassungssoftware Connexx 5.0/5.0a von Siemens mit dem unter "About Connexx" abrufbaren Fenster mit Datum "2004"; Others; 2004; DE.

D17: Dillon, H.:"Hearing aids", Thieme Verlag Stuttgart, New York, 2001, ISBN 1-58890-052-5, pp. 106-111 and 254-262; ISBN 1-58890-052-5, Others; 2001; US.

D18: Kuk, F. Büllow, M., Damsgaard, A., Ludvigsen, C. & Jessen, A. (2004), "Hearing Aid Fittings and the Use of Simulated Sound Environments" The Hearing Review, Aug. 2004, pp. 42-49; Others; 2004; US.

D19:Ludvigsen, C.: "Hearing aid fitting constraint by speech audibility, acoustic feed-back, and risk of hearing damage." in "Issues in Advanced Hearing Aid Research", Conference UCLA Lake Arrowhead Conference Center, Lake Arrowhead, Califonia, May 25-29, 1992; Others; 1992; US.

D20:Mueller, H.G.; Powers, T.A.: "Consideration of Auditory Acclimatzation in the Prescriptive Fitting of Hearing Aids", Seminars in Hearing, vol. 22, No. 2, 2001, pp. 103-119; Others; 2001; US.

D21:Chalupper, J.; Kasanmascheff, R.: "Use of psychoacoustic models for fitting ski slope hearing losses", in 21 Danavox Symposium on Hearing Aid Fitting, Aug. 31 until Sep. 2, 2005, Comwell, Kolding Danemark; Others; 2005; DK.

D22:Bustamante, D.K.; Worall, T.L.; Williamson, M.J.: "Measurement and Adaptive Supression of Acoustic Feedback in Hearing Aids", IEEE 1989, CH2673-2/89/0000-2017-2020; Others; 1989; US.

D23:Artikel "The role of adaption in hearing aid fitting process" (Zusammenfassungen), Seminars in Hearing, vol. 22, No. 2, 2001, ISSN 0734-0451 This pubiication i located centraly in AudLab department Consideration of Auditory Acclimatization in the Prescriptive Fitting of Hearing Aids by H. GMueller. and T A Powers; Others; 2001; US.

D24: Killion, M.C.; "Design nd Evalution of High-Fidelity Hearing Aids", PHD Thesis 1997, University Mikrofilms International, Ann Harbour, Michigan, USA; Others; 1997; US.

D25: Produktbroschüre zu Hörgerät "Sensodiva" von Widex, pp. 22 vol. 25, Drucklegung: Printed by FB09-00, siehe auch http://www.euha.org/i/index.phppage=Nachlese2001&lang=de &session=1a832918b694a1b8283fa59c679711dd#widex with Statement of Relevance for NPL Document.

D16-1-D16-5: Ausdrucke des Hilfemenüs der Connexx 5.0/5.0a Software zu den Themen "Show/Hide Target Gain", "Defining Target Gain", "NAL-NL1","Critical Gain Measurement" and "Sound Examples with MediaContral", Dec. 19, 2007, pp. 1-5.

* cited by examiner

METHOD FOR ADJUSTING A HEARING AID WITH HIGH-FREQUENCY AMPLIFICATION

CROSS REFERENCE TO RELATED APPLICATIONS

This application claims priority of German application No. 10 2006 019 694.5 filed Apr. 27, 2006, which is incorporated by reference herein in its entirety.

FIELD OF THE INVENTION

The present invention relates to a method for adjusting the amplification of a hearing aid by loudness-based or prescriptive adjustment of the amplification of the hearing aid in a lower frequency range and a different adjustment in the upper frequency range.

BACKGROUND OF THE INVENTION

The optimum amplification of a hearing aid for compensating loss of hearing is conventionally determined by loudness scalings or hearing threshold-based, prescriptive adaptation formulae. These formulae describe the target amplification as a function of the frequency and the sound level. The established formulae, such as NAL-NL1 or DSL-I/O, are defined for the frequency range 0 to 8 kHz. They say nothing about target amplification in the range above 8 kHz. This is primarily due to the fact that established hearing aids can only transmit frequencies below 8 kHz. An adaptation formula for high frequencies is therefore not required. In addition there is the fact that to measure high-pitch loss of hearing special audiometers are required and implementation of a defined amplification is very difficult in this frequency range (wavelength of the same order of magnitude as auricular canal geometries). However, as a result of special broadband amplifiers and electroacoustic converters hearing aids can nowadays be produced which can transmit frequencies above 8 kHz through to 15 kHz. One problem is accordingly adjustment of amplification in this frequency range to the loss of hearing, and this constitutes the subject matter of the present invention. In addition there is the fact that acoustic feedback can significantly affect the amplification adjustment. This applies to the entire frequency range in general but in particular to the frequency range above 6 kHz.

One approach to the solution to this problem lies in a loudness-normalizing adjustment. In this case amplification across the entire frequency range is adjusted by loudness scalings (narrow band stimuli) and comparison with reference scaling in people with normal hearing in such a way that the loudness impression normalizes, i.e. a stimulus with the hearing aid is perceived to be just as loud by a person who is hard of hearing as by a subject with normal hearing and without a hearing aid. Drawbacks in this connection are however the very long measuring times for the loudness scalings and the relatively frequent acoustic feedback. In addition, for the base frequency range it has not previously been possible to provide evidence of any advantage of a loudness-based adjustment over the "rapid", prescriptive adaptation formulae requiring only measurement of the audiogram.

A method for adjusting a hearing aid is known from publication DE 699 16 756 T2 with which the object of compensating a patient's audiogram is achieved. This is achieved in that certain frequency bands are amplified or attenuated.

A hearing aid is also known from publication DE 690 12 582 T2 in which acoustic feedback is rendered ineffective.

Publication DE 44 41 755 C1 describes a hearing aid circuit in which a first frequency channel and a second frequency channel exist in one embodiment.

Publication DE 41 25 378 C1 also discloses a hearing aid with a signal path for a lower frequency range and a further signal path for an upper frequency range.

A method for adjusting a hearing aid is known from publication DE 35 42 566 A1. In this case the user can change the steepness of the frequency response above a limit frequency.

A method for recording information in a hearing aid is also known from publication EP 1 414 271 A2. The information can be used to adjust the volume and to avoid feedback.

Publication EP 0 917 397 A1 also discloses a method for determining a set of parameters for a hearing aid. In this case the volume and feedback are again taken into account.

Finally a method for measuring the individual acoustic ratios in a human ear in which an audiogram is created is described in publication CH 678 692 A5.

SUMMARY OF THE INVENTION

The object of the present invention therefore lies in disclosing a method with which adjustment of hearing aid amplification in the higher frequency range, in particular above 8 kHz, is effectively possible with little effort and expenditure.

According to the invention this object is achieved by a method for adjusting the amplification of a hearing aid by loudness-based or prescriptive adjustment of the amplification of the hearing aid in a lower frequency range, carrying out an open-loop gain measurement in an upper frequency range adjoining the lower frequency range and fixing a maximum amplification or a frequency-dependent maximum amplification curve at least in the upper frequency range using the open-loop gain measurement.

A hybrid adjustment procedure is therefore provided in which a loudness-based or prescriptive adjustment in the lower frequency range and a different adjustment in the higher frequency range are carried out. Rapid adjustment is therefore possible in the high-frequency range since no audiometric measurements are required. In addition, adjustment of the amplification in the high-frequency range is distinguished by its robustness since feedback whistling is basically ruled out by the OLG (Open-Loop Gain) limitation.

A further advantage that should be emphasized lies in the fact that a good basic adjustment and high spontaneous acceptance by proven adaptation formulae are achieved in the base frequency range.

According to a development of the method according to the invention the feedback susceptibility is reduced by at least one narrow band filter and/or by a feedback reduction algorithm, so a higher maximum amplification or a higher maximum amplification curve may be attained. People with serious hearing damage can thereby also be catered for without feedback whistling occurring.

Starting from the maximum amplification curve, preferably at least one amplification located therebelow is obtained and the hearing aid wearer can choose one of the plurality of amplification curves for amplification. For this purpose it is advantageous to present the hearing aid wearer with sound examples, so he can interactively choose one of the plurality of amplification curves. The hearing aid wearer can make the choice with reference to everyday sounds. A subjective, optimum solution to amplification in the high-frequency range can thus quickly be found.

The amplification curve in the upper frequency range is advantageously adjusted to an amplification curve in the lower frequency range or vice versa or the two are adjusted to each other. This avoids points of discontinuity at the point of intersection between upper and lower frequency ranges.

According to a further embodiment of the present invention it is provided that amplification in the lower and/or upper frequency range is increased automatically with time. An acclimatization effect for the hearing aid wearer can be utilized as a result.

BRIEF DESCRIPTION OF THE DRAWINGS

The present invention will now be described in more detail with reference to the accompanying drawings, in which.

DETAILED DESCRIPTION OF THE INVENTION

The following exemplary embodiments described in more detail constitute preferred embodiments of the present invention.

Figure 1:
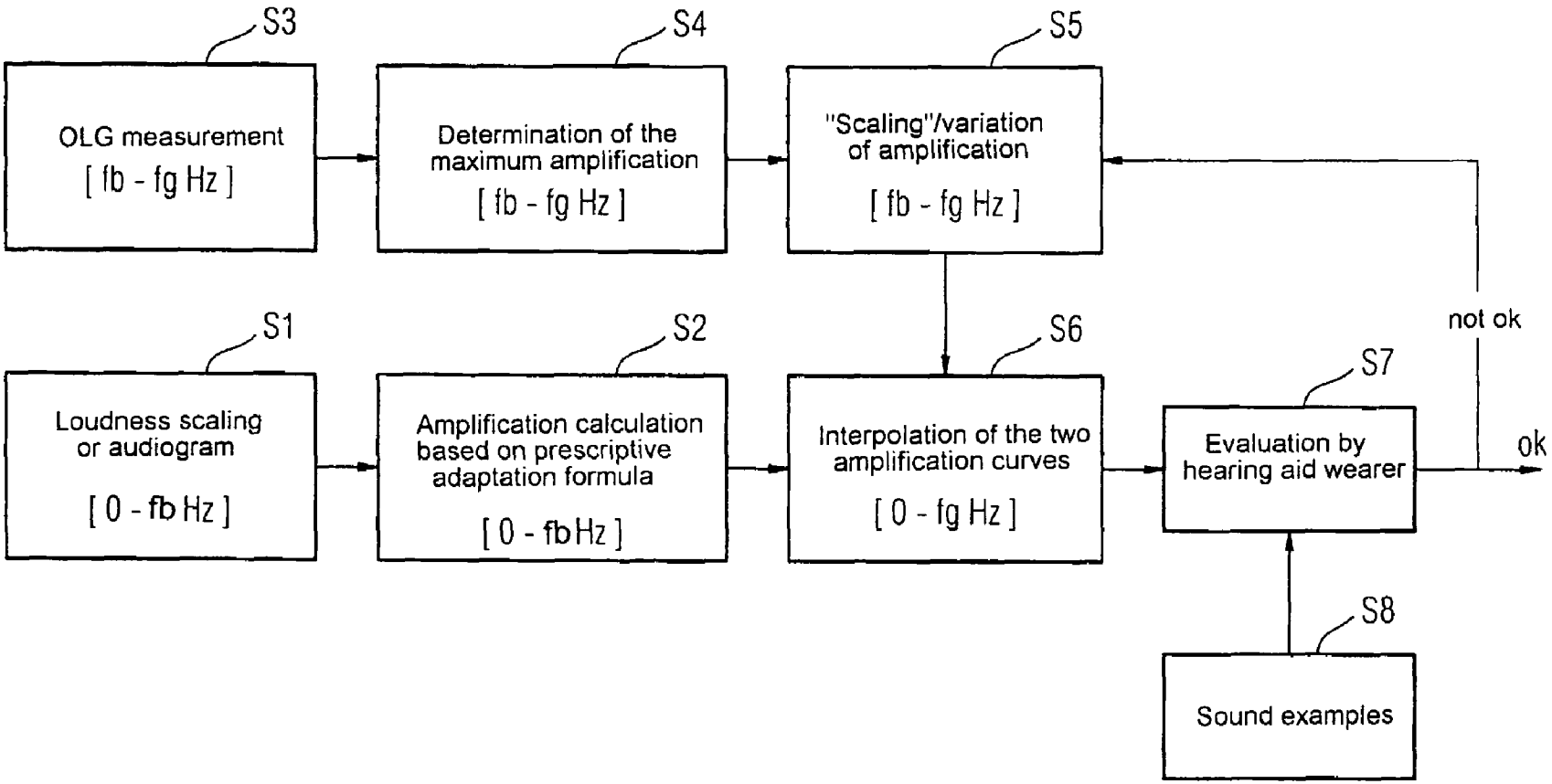
FIG. 1 shows a flow diagram for carrying out a method according to the invention for the adjustment or setting of a hearing aid and FIG. 2 shows smoothing of amplification curves at the boundary between lower and upper frequency ranges.

According to FIG. 1 conventional amplification adjustment takes place first of all in the lower frequency range or in the base frequency range [0-fb] according to steps S1 and S2. For this purpose loudness impressions are recorded by a hearing aid wearer in step S1, so an amplification adjustment can be carried out on the basis of the subjectively perceived loudness. Alternatively an audiogram of the patient is taken, so the hearing threshold thereof is known.

According to step S2 the amplifications or amplification curves which are to be implemented in the hearing aid are calculated from the loudness scaling or the audiogram. For this purpose prescriptive adaptation formulae are used which, for example, are known by the names NAL-NL1, DSL-I/O. Company-specific formulae as well as a loudness normalization may also be used for the amplification calculation. Ultimately an amplification curve or a family of amplification curves is obtained for the lower frequency range [0-fb Hz]. The base limit frequency fb lies, for example, at 6 kHz.

For the upper frequency range [fb-fg Hz] where fg is for example 12 kHz, what is known as an open-loop gain measurement (OLG measurement) is now carried out according to step S3. This OLG measurement can also be extended to the lower frequency range. For the OLG measurement the signal path of the hearing aid is interrupted for example, test sounds of various frequencies are digitally generated in the hearing aid, output via the hearing aid earpiece and the digital level of the signal again received by the hearing aid microphone(s) determined upstream of the interruption point. The difference from the original digital level of the test stimulus is the open-loop gain (OLG) with the aid of which the maximum possible amplification without feedback whistling (feedback limit) may be quantified. This determination of the maximum amplification corresponding to step S4 takes place for each frequency or each desired frequency band in the high frequency range [fb-fg]. A certain spacing [feedback reserve, preferably 6-12 dB] is advantageously maintained from the feedback limit to avoid feedback whistling even in the event of slight changes in the feedback path in everyday life.

The reduction in feedback susceptibility is optionally reduced by notch filters or other narrow band filters. Alternatively or additionally feedback reductive algorithms, such as oscillation detection and adaptive notch filters or feedback compensators, can be used. In each case the amplification range may be expanded hereby.

While taking account of the feedback limit (maximum amplification) and the feedback reserve a plurality of optional amplification curves are determined in step S5. For example the amplification curves consist of the maximum possible amplification in the upper frequency range Gmax (f) and reduced amplifications, derived therefrom, in the desired number. Percentage reduced curves for example, such as 75% Gmax (f), 50% Gmax (f), etc., may thus be provided. The amplification in the high-frequency range can be exactly adjusted using a plurality of bands, in particular by using a filter bank. Explicitly no prescriptive or loudness-based adjustment methods are therefore used in the high-frequency range.

The amplification curves from the low-frequency and high-frequency ranges would, as a rule, merge discontinuously. Smoothing of the discontinuous transition of the amplification stages is therefore carried out from the base frequency range to the high frequency range at f=fb according to step S6. Smoothing takes place for example by weighted addition within a frequency band [f1-f2], where f1<fb and f2>fb. In a specific example the following could apply: fb=6 kHz, f1=4 kHz and f2=8 kHz. A continuous amplification curve is therefore obtained for all amplification curves in the entire frequency range [0-fg].

In step S7 the hearing aid wearer chooses a variant that is suited to him or her from the whole family of amplification curves. For this purpose he is presented with sound examples or he can make the selection using the everyday acoustic environment. In both cases hearing situations, such as music, speech or the like, can be used (cf. step S8).

If the hearing aid wearer comes to the conclusion that the amplification in the high-frequency range is not suited to him or her, the amplification in the high-frequency range is varied according to step S5. The amplification curves of high-frequency and low-frequency ranges are subsequently smoothed again in step S6 and the hearing aid wearer can then evaluate the newly obtained amplification curve again in step S7.

If, finally, an amplification curve is okay for the hearing aid wearer this amplification curve is permanently implemented in the hearing aid. However, following selection of the amplification curve another automatic amplification increase may optionally also take place with time. The hearing aid wearer may thus gradually adjust, i.e. acclimatize, to the new hearing impression.

Figure 2:
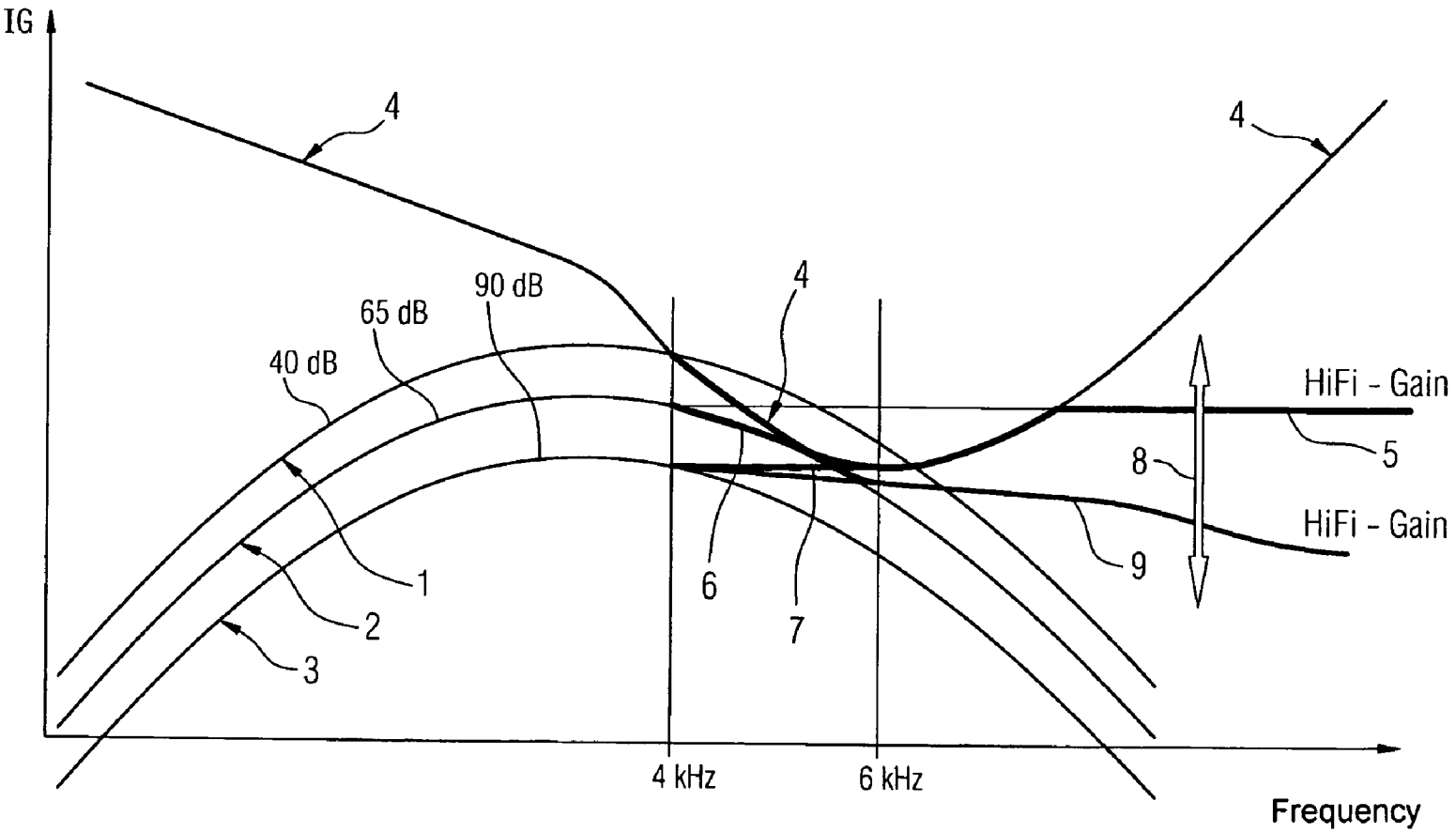

The above-mentioned smoothing or adjustment of the amplification curves in the high-frequency range and the low-frequency range can be described in more detail with reference to FIG. 2. Firstly the amplification target curve 1 for quiet levels, the amplification target curve 2 for medium levels and the amplification target curve 3 for loud levels are obtained by prescriptive adjustment, for example by the formula NAL-NL1. These amplification target curves are used in the lower frequency range up to 4 kHz (cf. steps S1 and S2). An OLG measurement is also performed over the entire frequency range and a maximum amplification 4 established by taking account of a feedback reserve (cf. steps S3 and S4).

In the higher frequency range from about 6 kHz the amplification is fixed according to a different adjustment method. For example the high-frequency fractions should be constantly amplified according to curve 5. Since the maximum amplification curve 4 intersects with the target curve 1 at about 4 kHz and with the amplification curve 5 at about 8 kHz, amplification for loud levels is limited to the maximum amplification in the range between 4 and 8 kHz. For medium and quiet levels interpolations are carried out in the range between 4 and 6 kHz which connect the amplification curve 5 or the maximum amplification curve 4 at about 6 kHz to the target amplification curve 2 or the target amplification curve 3 at 4 kHz. This results in the interpolation sections 6 and 7. A smooth transition from the respective amplification curve 1, 2 3 in the low-frequency range to the amplification curve 5 in the high-frequency range may thus be ensured.

Amplification in the high-frequency range can be varied according to arrow 8. An amplification curve 9 in the high-frequency range can, for example, equally be selected thereby. In this case this curve 9 is not obtained by division of the maximum amplification curve 4 by a constant factor according to the above-mentioned example either, rather the example of FIG. 2 is intended to show that the amplification curves in the high-frequency range can also be obtained by methods other than by constant division. Interpolation transitions to the target amplification curves 1 to 3 are also used for the amplification curve 9 in the frequency range between 4 kHz and 6 kHz.

The invention claimed is:

1. A method for adjusting an amplification of a hearing aid, comprising:

adjusting the amplification of the hearing aid in a lower frequency range;

performing an open-loop gain measurement in an upper frequency range adjoining the lower frequency range;

determining a frequency dependent maximum amplification curve in the upper frequency range using the open-loop gain measurement; and adjusting the amplification of the hearing aid in the upper frequency range using the maximum amplification curve, wherein an amplification curve below the maximum amplification curve is calculated in the upper frequency range and is merged to an amplification curve in the lower frequency range to provide a smooth transition from the amplification curve in the lower frequency range to the amplification curve in the upper frequency range.

2. The method as claimed in claim 1, wherein the amplification of the hearing aid in the lower frequency range is prescriptively adjusted or adjusted based on a loudness impression of a wearer of the hearing aid.

3. The method as claimed in claim 1, wherein feedback susceptibility of the hearing aid is reduced by a narrow band filter or a feedback reduction algorithm.

4. The method as claimed in claim 1, wherein a plurality of amplification curves below the maximum amplification curve are calculated in the upper frequency range.

5. The method as claimed in claim 4, wherein one of the amplification curves is selected and merged to an amplification curve in the lower frequency range.

6. The method as claimed in claim 5, wherein a wearer of the hearing aid is exposed to a sound and interactively selects the one amplification curve.

7. The method as claimed in claim 1, wherein the amplification of the hearing aid in the lower or upper frequency range is automatically increased with time.

8. The method as claimed in claim 1, wherein a maximum amplification is determined in the upper frequency range using the open-loop gain measurement.

9. The method as claimed in claim 1, wherein the upper frequency range is above 6 kHz or 8 kHz.

10. A hearing aid to be worn by a hearing aid wearer, comprising:

a first processing unit that adjusts an amplification of the hearing aid in a lower frequency range;

a measurement unit that performs an open-loop gain measurement in an upper frequency range adjoining the lower frequency range; and a second processing unit that determines a frequency dependent maximum amplification curve in the upper frequency range using the open-loop gain measurement, wherein an amplification curve below the maximum amplification curve is calculated in the upper frequency range and is merged to an amplification curve in the lower frequency range to provide a smooth transition from the amplification curve in the lower frequency range to the amplification curve in the upper frequency range.

11. The hearing aid as claimed in the claim 10, wherein the amplification of the hearing aid in the lower frequency range is prescriptively adjusted or adjusted based on a loudness impression of the hearing aid wearer.

12. The hearing aid as claimed in the claim 10, wherein feedback susceptibility of the hearing aid is reduced by a narrow band filter or a feedback reduction algorithm.

13. The hearing aid as claimed in the claim 10, wherein a plurality of amplification curves below the maximum amplification curve are calculated in the upper frequency range.

14. The hearing aid as claimed in the claim 13, wherein one of the amplification curves is selected and merged to an amplification curve in the lower frequency range.

15. The hearing aid as claimed in the claim 14, wherein the hearing aid wearer is exposed to a sound and interactively selects the one amplification curve.

16. The hearing aid as claimed in the claim 10, wherein the amplification of the hearing aid in the lower or upper frequency range is automatically increased with time.

17. The hearing aid as claimed in the claim 10, wherein a maximum amplification is determined in the upper frequency range using the open-loop gain measurement.

18. The hearing aid as claimed in the claim 10, wherein the upper frequency range is above 6 kHz or 8 kHz.

* * * * *